US010850503B2

(12) United States Patent
Lee et al.

(10) Patent No.: US 10,850,503 B2
(45) Date of Patent: Dec. 1, 2020

(54) PRINT HEAD DRIVING APPARATUS AND PRINTING APPARATUS HAVING THE SAME

(71) Applicant: WOOSIM SYSTEM INC., Chungcheongnam-do (KR)

(72) Inventors: Il Bok Lee, Gyeonggi-do (KR); Kwang Il Koo, Chungcheongnam-do (KR); Jae Kwang Lee, Seoul (KR)

(73) Assignee: WOOSIM SYSTEM INC., Chungcheongnam-do (KR)

( * ) Notice: Subject to any disclaimer, the term of this patent is extended or adjusted under 35 U.S.C. 154(b) by 0 days.

(21) Appl. No.: 16/354,578

(22) Filed: Mar. 15, 2019

(65) Prior Publication Data

US 2019/0351675 A1 Nov. 21, 2019

(30) Foreign Application Priority Data

May 21, 2018 (KR) ..... 10-2018-0057633

(51) Int. Cl.
*B41J 2/045* (2006.01)
*B41J 2/14* (2006.01)

(52) U.S. Cl.
CPC ..... *B41J 2/04541* (2013.01); *B41J 2/0458* (2013.01); *B41J 2/14112* (2013.01)

(58) Field of Classification Search
CPC ... B41J 2/04541; B41J 2/14112; B41J 2/0458
USPC ..... 347/9–12
See application file for complete search history.

(56) References Cited

U.S. PATENT DOCUMENTS 7,441,851 B2 * 10/2008 Liou ..... B41J 2/04541 347/12
2008/0111864 A1 5/2008 Yamaguchi et al.
2010/0002036 A1 1/2010 Jeong et al.
(Continued)

FOREIGN PATENT DOCUMENTS

JP H04296575 A 10/1992
KR 10-1999-0038210 A 6/1999
KR 10-2006-0010426 A 2/2006
(Continued)

OTHER PUBLICATIONS

Korean Patent Abstract (in English) of KR Patent App. Pub. No. 10-1999-0038210 A, Pub. Date Jun. 5, 1999, downloaded Mar. 13, 2019 from http://engpat.kipris.or.kr/engpat/biblioa.do.
(Continued)

*Primary Examiner* — An H Do
(74) *Attorney, Agent, or Firm* — Barcelo, Harrison & Walker, LLP

(57) ABSTRACT

Disclosed is a print head driving apparatus including: a print head unit having a plurality of heater resistors arranged therein, the plurality of heater resistors being divided into sub groups; a counter configured to sequentially generate code signals corresponding to the sub groups, using a driving clock signal; a driving signal generation unit configured to generate a driving signal for the heater resistors included in each of the sub groups, using the code signal; and a head control unit configured to extract heater resistors to which the driving signal is inputted, among heater resistors corresponding to input image data, and drive the extracted heater resistors.

10 Claims, 9 Drawing Sheets

(56) References Cited

U.S. PATENT DOCUMENTS

2010/0171777 A1 7/2010 Han et al.

FOREIGN PATENT DOCUMENTS

| | | | |
|---|---|---|---|
| KR | 10-2008-0043244 | A | 5/2008 |
| KR | 10-2010-0043244 | A | 5/2008 |
| KR | 10-2010-0081556 | A | 7/2010 |

OTHER PUBLICATIONS

Korean Patent Abstract (in English) of KR Patent App. Pub. No. 10-2010-0081556 A, Pub. Date Jul. 15, 2010, downloaded Mar. 13, 2019 from http://engpat.kipris.or.kr/engpat/biblioa.do.
Korean Patent Abstrat (in English) of KR Patent App. Pub. No. 10-2010-0004787, Pub. Date Jan. 13, 2010, downloaded Mar. 13, 2019 from http://engpat.kipris.or.kr/engpat/biblioa.do.
Korean Patent Abstract (in English) of KR Patent App. Pub. No. 10-2008-0043244, Pub. Date May 15, 2008, downloaded Mar. 13, 2019 from http://engpat.kipris.or.kr/engpat/biblioa.do.
Japanese Patent Abstract (in English) of JP Patent App. Pub. No. H04296575 A, Pub. Date Oct. 20, 1992, downloaded Feb. 22, 2019 from http://worldwide.espacenet.com/.
Korean Patent Abstract (in English) of KR Patent Pub. App. No. 10-2006-0010426 A, Pub. Date Feb. 2, 2006, downloaded Feb. 19, 2019 from http://engpat.kipris.or.kr/engpat/biblioa.do.
Office Action (in Korean) of KR Patent App. No. 10-2018-0057633 A, App. Date May 21, 2018, dated Aug. 1, 2018.

* cited by examiner

FIG. 6

| Fire Group # | HEATER REGISTER # (CORRESPONDS TO NOZZEL # IN CASE OF INKJET) | | | | | | | | | | | | | | | |
|---|---|---|---|---|---|---|---|---|---|---|---|---|---|---|---|---|
| Fire Group 1 | 1 | 20 | 39 | 58 | 77 | 96 | 115 | 134 | 153 | 172 | 191 | 210 | 229 | 248 | 267 | 286 |
| Fire Group 2 | 7 | 26 | 45 | 64 | 83 | 102 | 121 | 140 | 159 | 178 | 197 | 216 | 235 | 254 | 273 | 292 |
| Fire Group 3 | 13 | 32 | 51 | 70 | 89 | 108 | 127 | 146 | 165 | 184 | 203 | 222 | 241 | 260 | 279 | 298 |
| Fire Group 4 | 19 | 38 | 57 | 76 | 95 | 114 | 133 | 152 | 171 | 190 | 209 | 228 | 247 | 266 | 285 | 304 |
| Fire Group 5 | 6 | 25 | 44 | 63 | 82 | 101 | 120 | 139 | 158 | 177 | 196 | 215 | 234 | 253 | 272 | 291 |
| Fire Group 6 | 12 | 31 | 50 | 69 | 88 | 107 | 126 | 145 | 165 | 183 | 202 | 221 | 240 | 259 | 278 | 297 |
| Fire Group 7 | 18 | 37 | 56 | 75 | 94 | 113 | 132 | 151 | 170 | 189 | 208 | 227 | 246 | 265 | 284 | 303 |
| Fire Group 8 | 5 | 24 | 43 | 62 | 81 | 100 | 119 | 138 | 157 | 176 | 195 | 214 | 233 | 252 | 271 | 290 |
| Fire Group 9 | 11 | 30 | 49 | 68 | 87 | 106 | 125 | 144 | 163 | 182 | 201 | 200 | 239 | 258 | 277 | 296 |
| Fire Group 10 | 17 | 36 | 55 | 74 | 93 | 112 | 131 | 150 | 169 | 188 | 207 | 226 | 245 | 264 | 283 | 302 |
| Fire Group 11 | 4 | 23 | 42 | 61 | 80 | 99 | 118 | 137 | 156 | 175 | 194 | 213 | 232 | 251 | 270 | 289 |
| Fire Group 12 | 10 | 29 | 48 | 67 | 86 | 105 | 124 | 143 | 162 | 181 | 200 | 219 | 238 | 257 | 276 | 295 |
| Fire Group 13 | 16 | 35 | 54 | 73 | 92 | 111 | 130 | 149 | 168 | 187 | 206 | 225 | 244 | 263 | 282 | 301 |
| Fire Group 14 | 3 | 22 | 41 | 60 | 79 | 98 | 117 | 136 | 155 | 174 | 193 | 212 | 231 | 250 | 269 | 288 |
| Fire Group 15 | 9 | 28 | 47 | 66 | 85 | 104 | 123 | 142 | 161 | 180 | 199 | 218 | 237 | 256 | 275 | 294 |
| Fire Group 16 | 15 | 34 | 53 | 72 | 91 | 110 | 129 | 148 | 167 | 186 | 205 | 224 | 243 | 262 | 281 | 300 |
| Fire Group 17 | 2 | 21 | 40 | 59 | 78 | 97 | 116 | 135 | 154 | 173 | 192 | 211 | 230 | 249 | 268 | 287 |
| Fire Group 18 | 8 | 27 | 46 | 65 | 84 | 103 | 122 | 141 | 160 | 179 | 198 | 217 | 236 | 255 | 274 | 293 |
| Fire Group 19 | 14 | 33 | 52 | 71 | 90 | 109 | 128 | 147 | 166 | 185 | 204 | 223 | 242 | 261 | 280 | 299 |

PRINT HEAD DRIVING APPARATUS AND PRINTING APPARATUS HAVING THE SAME

CROSS-REFERENCE TO RELATED APPLICATIONS

This application claims priority from Korean Patent Application No. 10-2018-0057633, filed May 21, 2018, in the Korean Intellectual Property Office. The entire contents of said application are incorporated herein by reference for all purposes.

BACKGROUND OF THE INVENTION

Technical Field

The present invention relates to a print head driving apparatus which is a thermal inkjet print head using a thermal method among ink jetting methods of an inkjet print and a printing apparatus having the same, and more particularly, to a print head driving apparatus which can decrease the number of input/output terminals by efficiently improving an interface for driving a print head, and thus reduce a cost by applying a head with a smaller width and size, and a printing apparatus having the same.

Disclosure Art

A thermal printer using a general thermal paper uses a method of printing information by applying heat to a thermal paper at the final printing stage, the heat being generated by applying a current to heater resistors disposed in a head unit. In addition, a thermal inkjet printer uses a method of printing information by heating and jetting a small amount of ink. That is, both of the two types of printers have something in common in that the printers generate heat by applying a current to heater resistors for a predetermined time at the final printing step.

Therefore, the most basic consideration in printer design is to determine in what order several hundreds of heater resistors disposed in the print head unit are to be driven, depending on image data to be printed. That is because the method for driving the heat resistors may decide the types and number of necessary signals, and change the printing quality, printing speed, power consumption and consumption profile of the printer.

Accordingly, an efficient printer signal interface needs to be able to minimize the number of necessary signals, facilitate the use of the signals, lower interference between adjacent channels to minimize a reduction in printing quality even though the printing speed is raised, and minimize momentary power consumption.

Therefore, there is a need to consider a method capable of driving a print head through an improved printer interface to satisfy such conditions, thereby improving the entire printer performance.

SUMMARY OF THE INVENTION

The present invention has been made in an effort to provide an efficient print head driving apparatus which can reduce the width and size of an inkjet head by decreasing the number of signals of an interface for driving a print head and thus reduce a cost, and a printing apparatus having the same.

An exemplary embodiment of the present invention provides a print head driving apparatus including: a print head unit having a plurality of heater resistors arranged therein, the plurality of heater resistors being divided into sub groups; a counter configured to sequentially generate code signals corresponding to the sub groups, using a driving clock signal; a driving signal generation unit configured to generate a driving signal for the heater resistors included in each of the sub groups, using the code signal; and a head control unit configured to extract heater resistors to which the driving signal is inputted, among heater resistors corresponding to input image data, and drive the extracted heater resistors.

The head control unit may perform an AND operation on the driving signal and the image data, extract heater resistors corresponding to the AND operation result of 1, and drive the extracted heater resistors.

The head control unit may drive the heater resistors during a pulse retention time of the driving signal.

The counter may change the code signal in each cycle of the driving clock signal, and input the code signal to the driving signal generation unit while retaining the code signal within the same cycle.

When a fire signal is inputted while the code signal is retained, the driving signal generation unit may transfer the driving signal to the head control unit in response to the fire signal.

The driving signal generation unit may set the transfer timing and the pulse retention time of the driving signal, using the fire signal.

The print head driving apparatus may further include: a shift register configured to shift image data inputted from an input terminal, and input the shifted image data to a latch unit; and the latch unit configured to store the image data inputted from the shift register according to a latch signal, and input the image data to the head control unit.

The counter may use the latch signal as a reset signal.

The driving signal generation unit may generate the driving signal to turn on a power-driving switching element for driving the heater resistors in a logic high-level period of the driving clock signal.

Another exemplary embodiment of the present invention provides a printing apparatus including the print head driving apparatus.

The above-described exemplary embodiments do not enumerate all of the characteristics of the present invention. Various characteristics of the present invention and advantages and effects depending on the characteristics will be understood in more detail with reference to the following exemplary embodiments.

According to exemplary embodiments of the present invention, the print head driving apparatus and the printing apparatus having the same can divide and drive the heater resistors into a desired number of sub groups without increasing the number of signals of the printer interface, and facilitate design in the case of a mobile print using a battery as power, thereby reducing a cost.

The entire cycle of a counter driving clock signal becomes a printing speed and a logic high-level period of the driving signal becomes a turn-on time of a switching element for driving heater resistors. Therefore, when the PWM function mounted in most common CPUs is used, such a driving signal can be easily implemented.

When an ASIC (Application Specific Integrated Circuit) is designed, only a small number of pins may be used due to a small number of signals, which makes it possible to minimize the chip die size of the ASIC which is a decisive element of an inkjet head price.

Since the print head driving apparatus and the printing apparatus having the same according to the exemplary embodiments of the present invention can be operated independently of an operation of an image loading unit of image data, the print head driving apparatus and the printing apparatus having the same can be applied even when serial data communication using two or more channels is used (for example, multi-column head), or when parallel loading is used in some cases.

BRIEF DESCRIPTION OF THE DRAWINGS

FIG. 6 is a table showing examples of heater resistors assigned to the respective sub groups of the print head driving apparatus according to an exemplary embodiment of the present invention.

DETAILED DESCRIPTION

Figure 1:
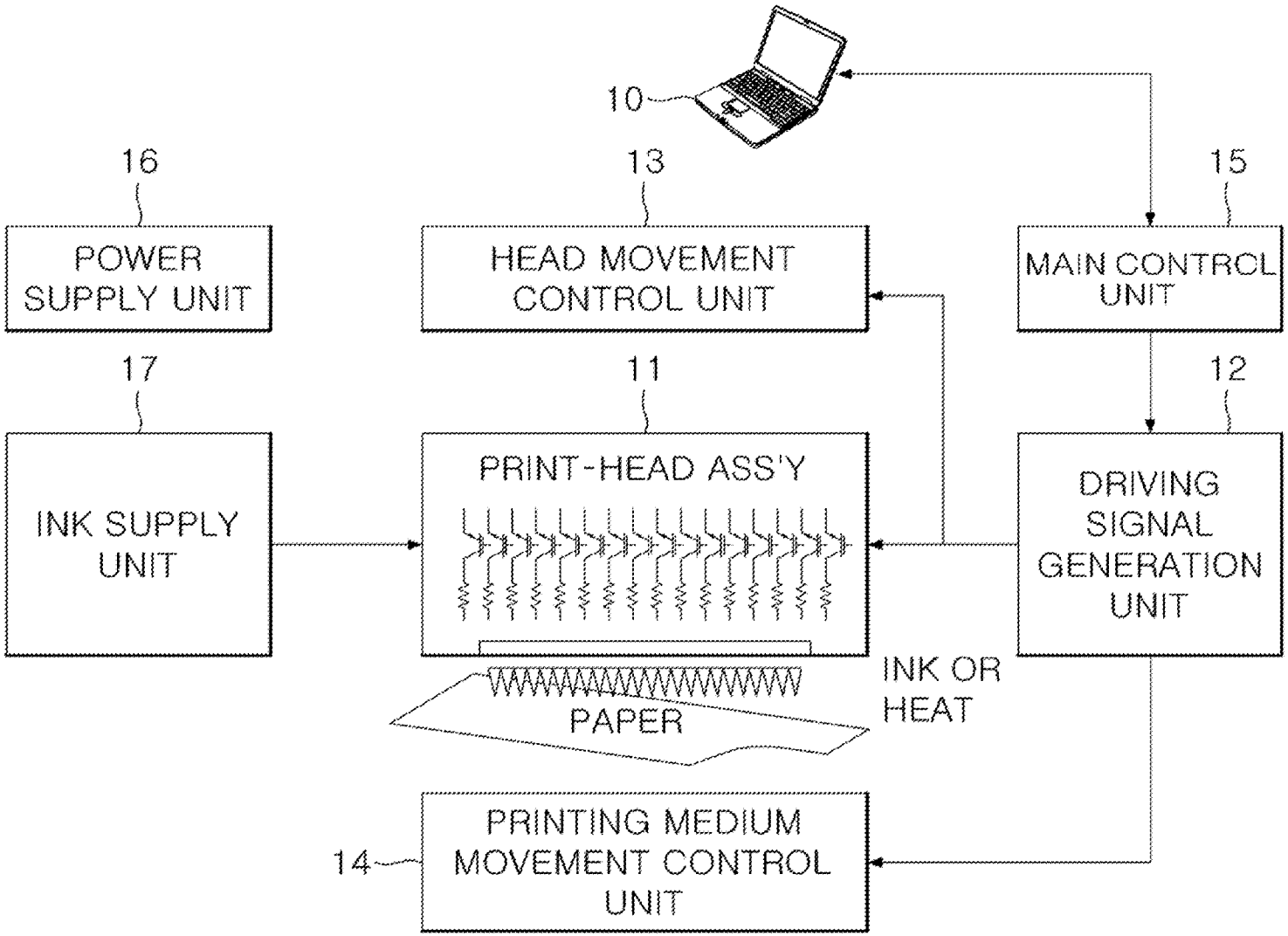
FIG. 1 is a block diagram illustrating a printing apparatus.

Hereafter, exemplary embodiments disclosed in this specification will be described in detail with the accompanying drawings. Regardless of reference numerals, the same or similar components will be represented by the same reference numbers, and the duplicated descriptions thereof will be omitted herein. Suffixes such as "module" and "unit", which are used for components in the following descriptions, are given or used together in consideration of only convenience for specification writing, and thus have no meanings or roles to distinguish from one another. That is, the term such as 'unit' used in this specification indicates a software component or a hardware component such as FPGA or ASIC, and 'unit' plays certain roles. However, 'unit' is not limited to software or hardware. That is, 'unit' may be configured in an addressable storage medium, and configured to reproduce one or more processors. Thus, for example, 'unit' includes components, processes, functions, attributes, procedures, sub routines, segments of program codes, drivers, firmware, micro codes, circuits, data, databases, data structures, tables, arrays and variables, the components including software components, objected-oriented software components, class components and task components. Components and functions provided within 'units' may be coupled to a smaller number of components and 'units' or further divided into additional components and 'units'.

When exemplary embodiments disclosed in this specification are described, detailed descriptions related to publicly known functions or configurations will be ruled out in order not to unnecessarily obscure subject matters of the exemplary embodiments disclosed in this specification. Furthermore, it should be understood that the accompanying drawings are only used to promote understandings of the exemplary embodiments disclosed in this specification, do not limit the technical idea disclosed in this specification, and include all modifications, equivalents and substitutes included in the spirit and scope of the present invention.

FIG. 1 is a block diagram illustrating a printing apparatus. Referring to FIG. 1, the printing apparatus may include a print head unit 11, a driving signal generation unit 12, a head movement control unit 13, a printing medium movement control unit 14, a main control unit 15 and a power supply unit 16. In the case of an inkjet printer, an ink supply unit 17 may be further included.

The print head unit 11 may be a thermal inkjet print head which corresponds to a thermal method between two techniques for ink jetting of an inkjet printer, that is, a piezoelectric method and the thermal method. In this case, the print head unit 11 includes a plurality of heater resistors, and the driving signal generation unit 12 generates signals for driving the heater resistors. The head movement control unit 13 controls the movement of the head, and the printing medium movement control unit 14 controls the movement of a printing medium such as paper.

The main control unit 15 provides an interface with a device 10 which provides data to print, and typically controls overall operations of the printer by controlling operations of the respective units. The power supply unit 16 receives external power or internal power, and supplies power required for the operations of the respective components. In the case of an inkjet printer, the ink supply unit 17 may supply ink.

In such a configuration, a thermal printer uses a method of printing information by applying heat to a thermal paper, the heat being generated by applying a current to the heater resistors installed in the print head unit 11 at the final stage. The inkjet printer uses a method of printing information by heating and jetting a small amount of ink. Therefore, both of the two types of printers have something in common in that the printers generate heat by applying a current to the heater resistors for a predetermined time at the final stage.

Figure 2:
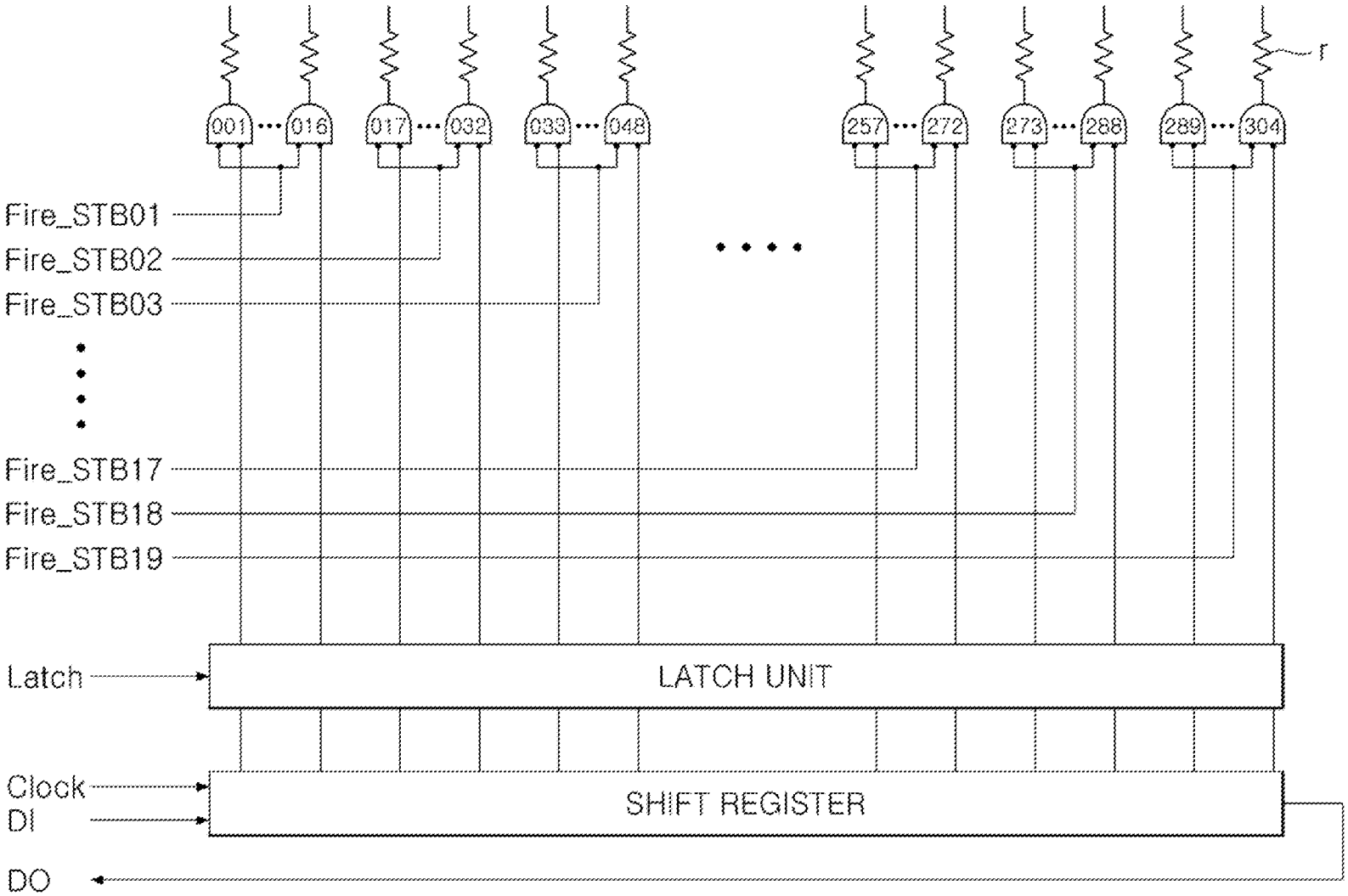
FIG. 2 is a schematic view illustrating a print head driving apparatus in which heater resistors are divided into sub groups.

FIG. 2 is a schematic view illustrating a configuration of the print head driving apparatus in which the heater resistors are divided into sub groups.

Referring to FIG. 2, the print head unit 11 may be configured in such a manner that 16 heater resistors are assigned to each of the sub groups. In many cases, a typical thermal print head unit is configured in such a manner that 64 heater resistors are assigned to each sub group. As illustrated in FIG. 2, however, the number of heater resistors assigned to each of the sub groups may be decreased to 16, which makes it possible to reduce the peak power consumption.

However, when the number of heater resistors assigned to each of the sub groups is decreased, the number of driving signals is increased. For example, when 304 heater resistors are assigned in such a manner that 16 heater resistors are assigned to each of the sub groups, the number of strobe signals Fire_STB01 to Fire_STB19 for driving the heater resistors is increased to 19. That is, when the number of heater resistors assigned to each of the sub groups is decreased, the peak power consumption can be reduced, but the number of signals for driving the heater resistors is increased.

The number of strobe signals is increased as the number of heater resistors assigned to each of the sub groups is decreased or the number of sub groups is increased. Furthermore, the number of strobe signals is increased as the total number of heater resistors included in the head is increased. That is, a high-resolution printer has a large number of strobe signals.

As illustrated in FIG. 2, the heater resistors assigned to each of the sub groups are generally numbered by 1 to 16, 17 to 32, 33 to 48, or the like, which means that the heater resistors are grouped and assigned by adjacent channels. Such an assignment method has no problem with the thermal printer. In the inkjet printer, however, the assignment method may cause interference between adjacent channels, and thus degrade a printing quality. In order to prevent the degradation in printing quality, the printing speed needs to be lowered.

Figure 3:
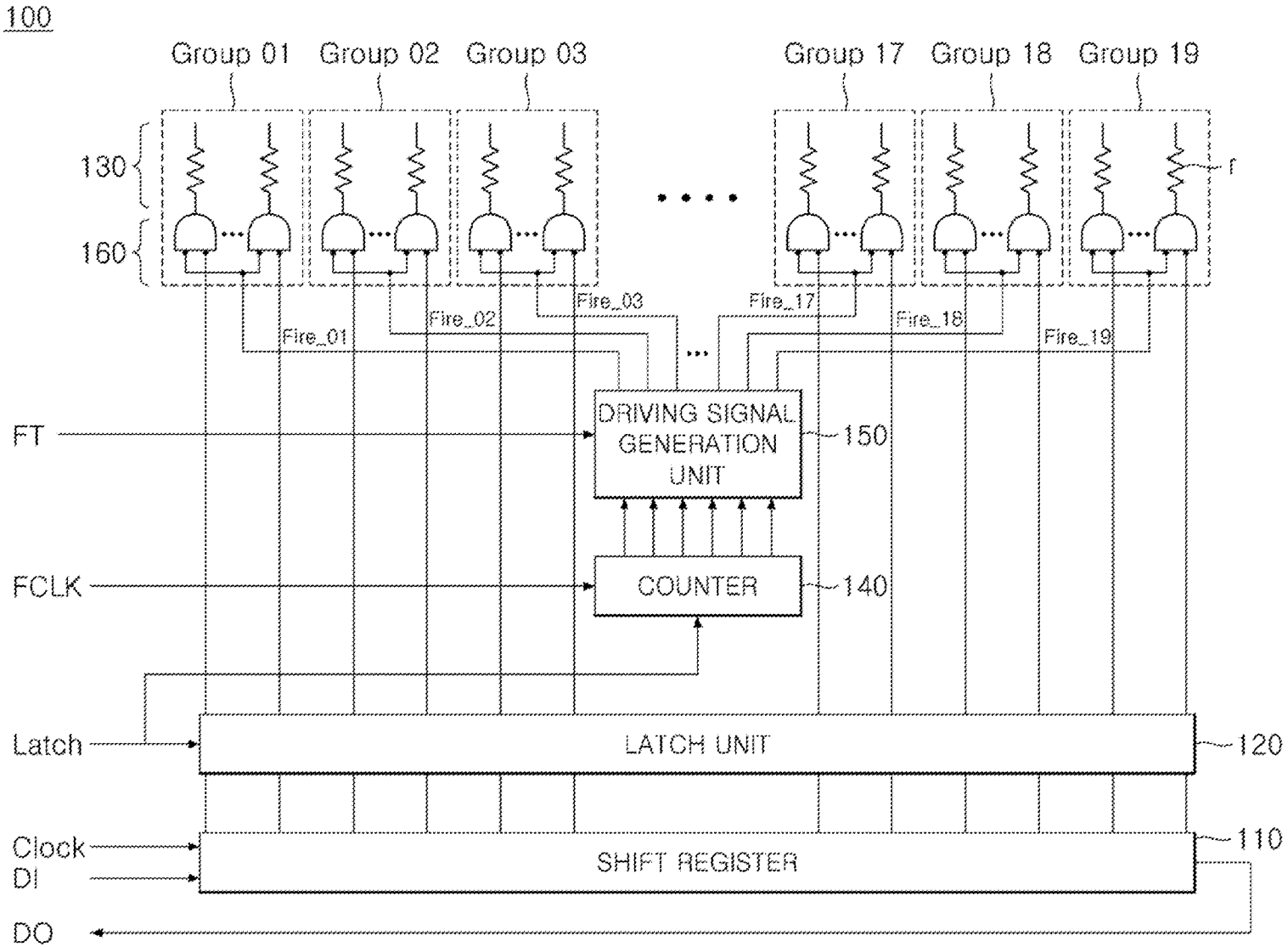
FIG. 3 is a schematic view illustrating a print head driving apparatus according to an exemplary embodiment of the present invention.

FIG. 3 is a schematic view illustrating a print head driving apparatus according to an exemplary embodiment of the present invention.

Referring to FIG. 3, a printer head driving apparatus 100 according to the exemplary embodiment of the present invention may include a shift register 110, a latch unit 120, a print head unit 130, a counter 140, a driving signal generation unit 150 and a head control unit 160.

Hereafter, the print head driving apparatus according to the exemplary embodiment of the present invention will be described with reference to FIG. 3.

The shift register 110 may receive image data DI from an input terminal, shift the image data DI, and input the shifted image data to the latch unit 120. That is, the shift register 110 may divide the received image data DI into a plurality of data each corresponding to an amount which can be printed at once, depending on the head configuration of the print head unit 130 or the like, and transfer the data to the latch unit 120.

The latch unit 120 may store the image data inputted from the shift register 110 according to a latch signal Latch, and input the stored image data to the head control unit 160. The latch unit 120 may retain the shifted and inputted image data until the print head unit 130 outputs the image data. Then, when the latch signal Latch is inputted, the latch unit 120 may update and store the image data for the next output.

The print head unit 130 may include a plurality of heater resistors r divided into sub groups. The number of sub groups included in the print head unit 130 and the number of heater resistors included in each of the sub groups may be set to various values depending on exemplary embodiments. The present exemplary embodiment is based on the supposition that the plurality of heater resistors are divided into 19 sub groups Group 01 to Group 19, and 16 heater resistors r are assigned to each of the sub groups. However, the present invention is not limited thereto.

FIG. 3 illustrates that the heater resistors positioned in the same sub group are positioned adjacent to each other. In reality, however, the heater resistors may be spaced apart from each other. That is, the heater resistors assigned to each sub group may have a staggered layout. Such a layout can minimize interference between channels.

Figure 8:
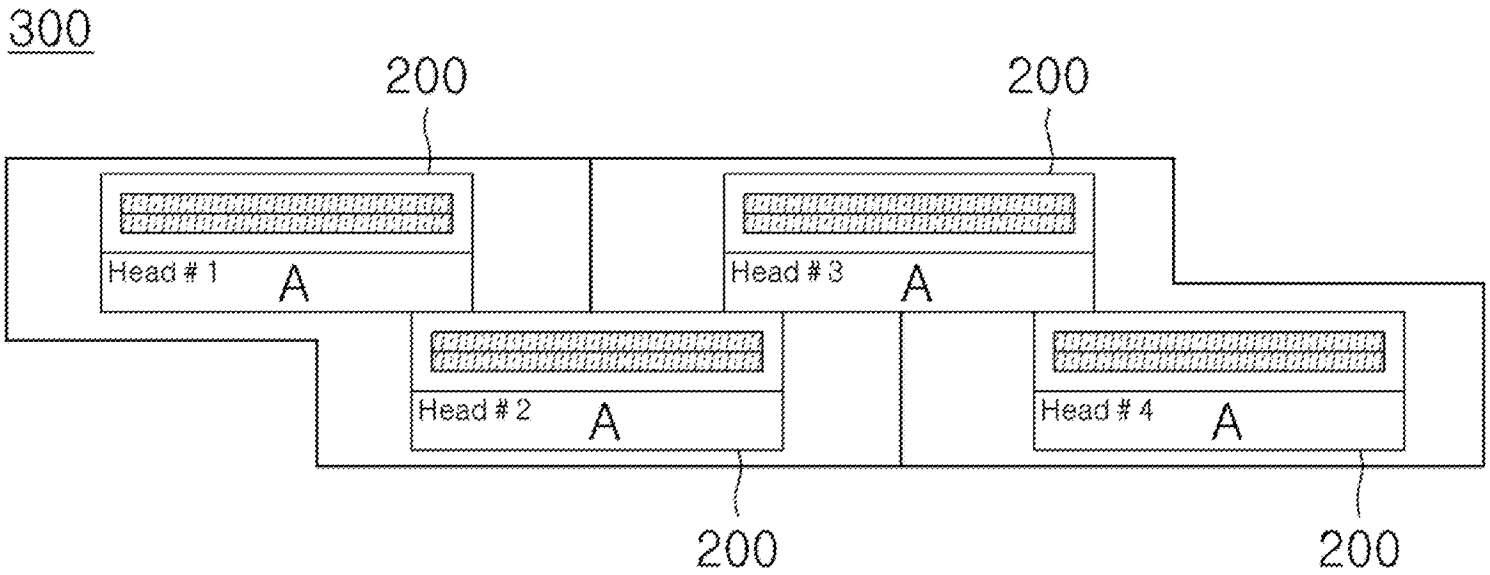
FIG. 8 is a schematic view illustrating a print head block driving apparatus according to an exemplary embodiment of the present invention.

Specifically, FIG. 6 shows that the heater resistors having different heater resistor numbers are assigned to each of the sub groups. As illustrated in FIG. 8, the heater resistor numbers may be consecutively given to the adjacent heater resistors.

The plurality of heater resistors r arranged in the print head unit 130 may generate heat using a current applied thereto, and each of the heater resistors r may heat and jet a small amount of ink. Under the print head unit 130, a printing medium such as paper may be positioned, and printing may be performed by the ink jetted by the respective heater resistors r. Since the ink is jetted to positions corresponding to the respective heater resistors r, a character or image corresponding to the image data may be outputted onto the printing medium. The heater resistors r to which the current is applied, among the plurality of heater resistors r, may be set and controlled by the head control unit 160.

Figure 4:
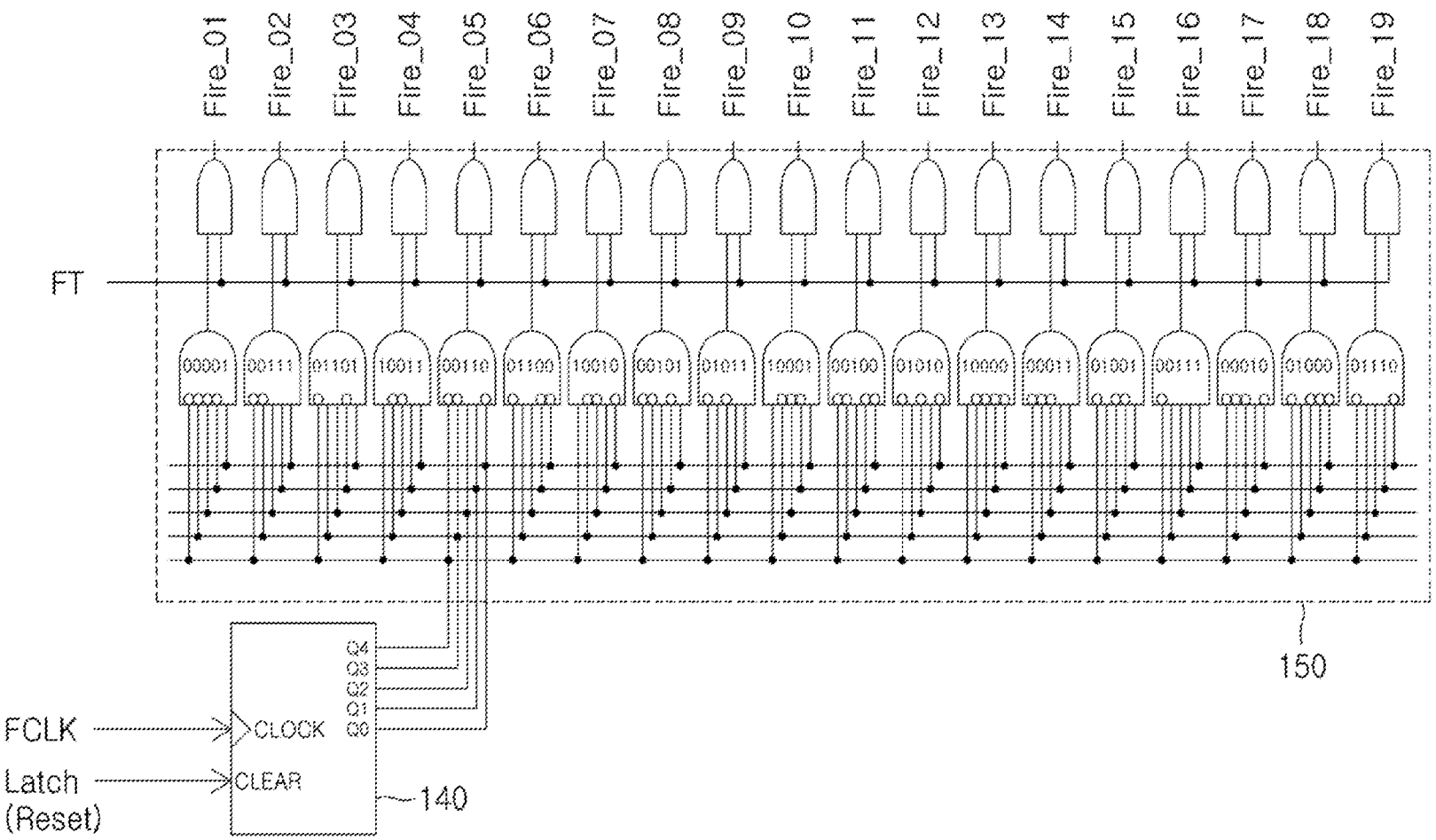
FIG. 4 is a schematic view illustrating a driving signal generation operation of the print head driving apparatus according to an exemplary embodiment of the present invention.

The counter 140 may sequentially generate code signals Q[n] corresponding to the sub groups, using a driving clock signal FCLK. The code signals Q[n] may correspond to the unique numbers of the respective sub groups. In each cycle of the driving clock signal FCLK, the counter 140 may change and generate the corresponding code signal Q[n]. Referring to FIG. 4, the counter 140 may receive the driving clock signal FCLK and the latch signal Latch, generate the code signal Q[n], and transfer the generated code signal to the driving signal generation unit 150. When 19 sub groups are provided, five bits Q0, Q1, Q2, Q3 and Q4 may be used to generate the code signals corresponding to the 19 sub groups, respectively. In some exemplary embodiments, however, the number of sub groups may be changed. In this case, the number of bits contained in the code signal may be differently set depending on the number of sub groups.

The counter 140 may generate and transfer a code signal of 0001 corresponding to the first sub group Group 01 in a first cycle of the driving clock signal FCLK, generate and transfer a code signal of 0010 corresponding to the second sub group Group 02 in a second cycle of the driving clock signal FCLK, and generate and transfer a code signal of 0011 corresponding to the third sub group Group 03 in a third cycle of the driving clock signal FCLK. When sequentially generating the code signals in this way to generate a code signal of 10011 corresponding to the 19th sub group Group 19, the counter 140 may sequentially regenerate the code signals from the code signal of 0010 corresponding to the first sub group Group 01. During one cycle of the driving clock signal FCLK, the counter 140 may retain the generated code signal. That is, in order to perform a printing operation by a different sub group in each cycle of the driving clock signal FCLK, the counter 140 may generate the corresponding code signal and transfer the generated code signal to the driving signal generation unit 150.

Additionally, the counter 140 may use the latch signal Latch as a reset signal Reset. The latch signal Latch corresponds to a signal which is shifted by the shift register 110 to input new image data to the latch unit 120. That is, when the image data inputted to the latch unit 120 is completely printed, the counter 140 may input the next image data to the latch unit 120 using the latch signal Latch. Therefore, when the latch signal Latch is inputted, the counter 140 may repeatedly generate the code signal Q[n] until the next latch signal is inputted, such that printing operations by the respective sub groups are sequentially performed until the corresponding image data is completely printed. Then, when the latch signal is inputted again, it may indicate that the corresponding image data is completely printed. Thus, the counter 140 may be reset and repeatedly generate the code signal Q[n] from the beginning.

The driving signal generation unit 150 may generate driving signals fire_01 to fire_19 for the heater resistors included in the sub groups, using the code signals Q[n]. As illustrated in FIG. 4, the driving signal generation unit 150 may receive the code signal Q[n] from the counter 140, and generate a group signal fire_group for the sub group corresponding to the received code signal. However, when the code signal is inputted, the driving signal generation unit 150 may not immediately output the driving signal fire_01, . . . or fire_19 corresponding to the code signal, but generate and transfer the driving signal fire_01, . . . or fire_19 only in the case that the group signal fire_group and a fire signal FT are inputted at the same time.

For example, when the code signal is 10010, the driving signal generation unit 150 may generate a group signal fire_group corresponding to the 18th sub group. Then, when the fire signal FT is inputted to the driving signal generation unit 150, the driving signal generation unit 150 may generate the driving signal fire_18 to the 18th sub group. The driving signal generation unit 150 may decide the transfer timing and pulse retention time of the driving signal according to the fire signal FT. That is, according to the input code signal, the driving signal generation unit 150 may retain the group signal fire_group during one cycle of the driving clock signal FCLK, and then generate and output the driving signal at the timing that the fire signal FT is inputted. Moreover, the driving signal generation unit 150 may retain the driving signal only while the fire signal FT is retained. That is, the pulse retention time of the driving signal may be equal to the retention time of the fire signal FT.

Figure 5:
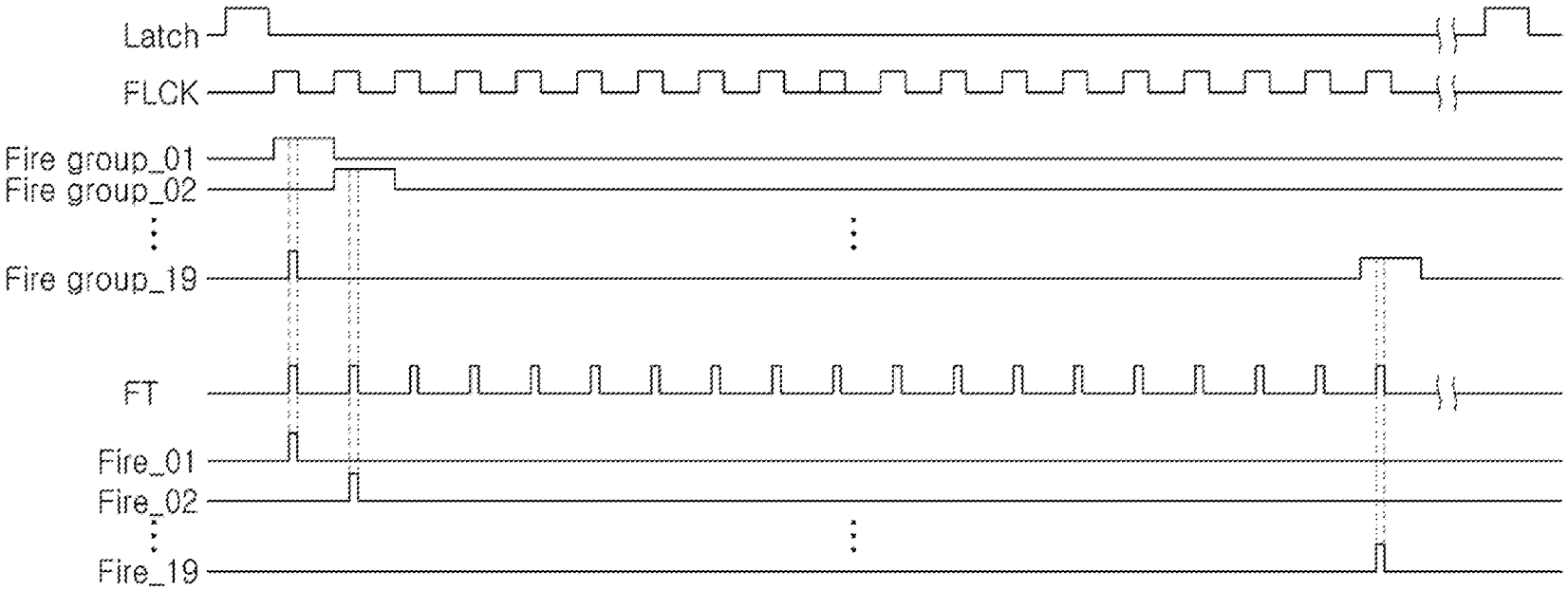
FIG. 5 is a timing diagram for describing the driving signal generation operation of the print head driving apparatus according to an exemplary embodiment of the present invention.

Specifically, as illustrated in FIG. 5, the driving clock signal FCLK may be constantly inputted in each cycle, and the counter 140 may change the code signal in each cycle, using the driving clock signal FCLK, and input the changed code signal to the driving signal generation unit 150. In this case, the driving signal generation unit 150 may generate the group signal fire group_1, . . . or fire group_19 corresponding to each of the code signals. That is, as illustrated in FIG. 5, the group signal fire group_01, . . . or fire group_19 corresponding to each of the sub groups may be sequentially changed in each cycle of the driving clock signal FCLK, and turned on during one cycle of the driving clock signal FCLK.

However, the driving signals fire_01 to fire_19 may not be turned on in response to the respective group signals fire group_1 to fire group_19, but turned on at the timing that the fire signal FT is inputted, and outputted during the retention time of the fire signal FT.

Additionally, while the driving signal fire_01, . . . or fire_19 retains a logic high level, a current-driving switching element for driving the heat resistor may be turned on. Therefore, the driving time and driving timing of the heater resistor can be adjusted through the fire signal FT.

The head control unit 160 may extract heater resistors to which the driving signal is inputted, among heater resistors corresponding to the input image data, and drive the extracted heater resistors. As illustrated in FIG. 3, the head control unit 160 may receive the image data inputted from the latch unit 120 and the driving signal inputted by the driving signal generation unit 150. That is, heater resistors to be driven may be selected by the image data, and the heater resistors included in the sub group corresponding to the current output may be selected among the heater resistors, according to the driving signal.

Specifically, the head control unit 160 may include AND gates corresponding to the respective heater resistors, perform an AND operation on the input driving signal and the image data, and extract heater resistors corresponding to the AND operation result of 1. That is, when the AND operation result is 1, it may indicate that the driving signal and the image data are inputted at the same time. Thus, the head control unit 160 may operate the corresponding heater resistors to perform printing.

The image data is constantly retained before a new latch signal is applied, but the driving timing and pulse retention time of the driving signal are set by the fire signal FT when the driving signal is inputted. Therefore, the head control unit 40 drives the heater resistor at the driving timing that the driving signal is inputted, during the pulse retention time of the driving signal. That is, according to the input driving signal, the head control unit 160 may control the driving timing and driving time of the heater resistors included in the corresponding sub group.

The head control unit 160 may turn on the current-driving switching element corresponding to the heater resistor to which the driving signal and the image data are inputted at the same time, and apply a current to the corresponding heater resistor through the switching element. Then, ink heated by the heater resistor may be jetted to perform printing.

Figure 7:
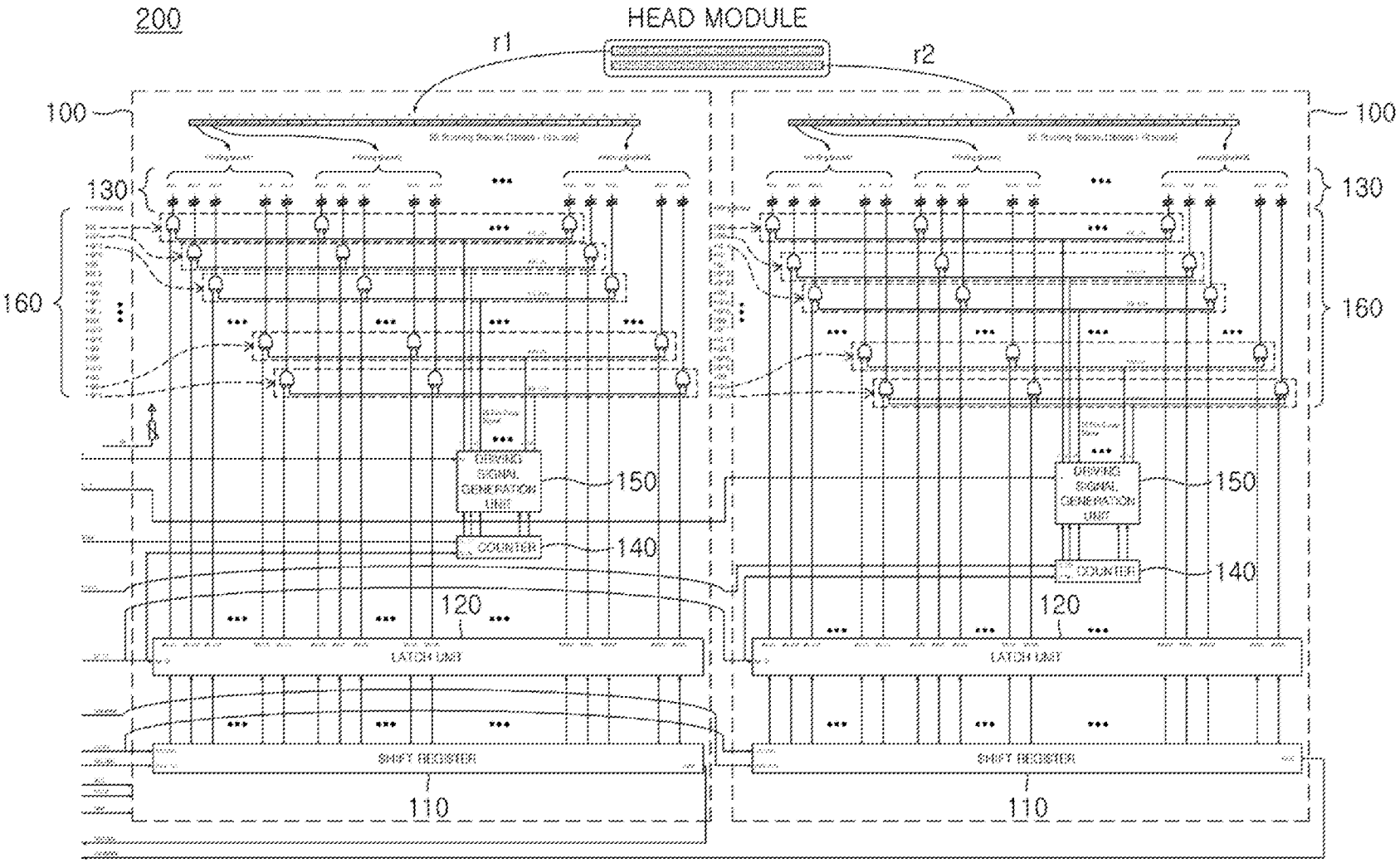
FIG. 7 is a schematic view illustrating a print head module driving apparatus according to an exemplary embodiment of the present invention.

In some exemplary embodiments, as illustrated in FIG. 7, a print head module driving apparatus 200 including a plurality of print head driving apparatuses 100 can be implemented. As illustrated in FIG. 7, the print head units 130 may be arranged to form two rows r1 and r2, and each of the print head driving apparatuses 100 may control the operations of the corresponding print head units 130. Then, under control of the individual print head driving apparatuses 100, ink may be jetted from the respective rows r1 and r2, in order to perform printing. In some exemplary embodiments, print head driving apparatuses 100 can be further added to increase the number of rows included in the print head module driving apparatus 200. Since the specific operations of the print head driving apparatus 100 have been described above, the detailed descriptions thereof will be omitted herein.

As illustrated in FIG. 7, the print head units 130 may be divided into 32 printing blocks, and one printing block may include 19 heater resistors r. Each of the heater resistors r may correspond to a nozzle, and ink heated by the heater resistor r may be jetted through the nozzle.

The heater resistors set to the same sub group may be selected one by one by different printing blocks. That is, as illustrated in FIG. 7, 32 heater resistors selected by the 32 printing blocks, respectively, may form one sub group. Since 19 heater resistors r are included in each of the printing blocks, the total number of sub groups may be set to 19. FIG. 6 shows that the heater resistor numbers of the heater resistors included in each of the sub groups fire_group form an arithmetical progression with a difference of 19. As the heater resistors r positioned in the same sub group have a staggered layout by 19 intervals, it is possible to minimize interference between ink flow path channels at each nozzle, which may occur when ink of adjacent channels is jetted at the same time.

As illustrated in FIG. 8, a print head block driving apparatus 300 can be implemented with a plurality of print head module driving apparatuses 200. For example, as illustrated in FIG. 8, four print head module driving apparatuses 200 may be combined to form one print head block driving apparatus 300. The print head module driving apparatus 200 may be positioned in each region A, and the four print head module driving apparatuses 200 may be arranged in a zigzag shape.

Figure 9:
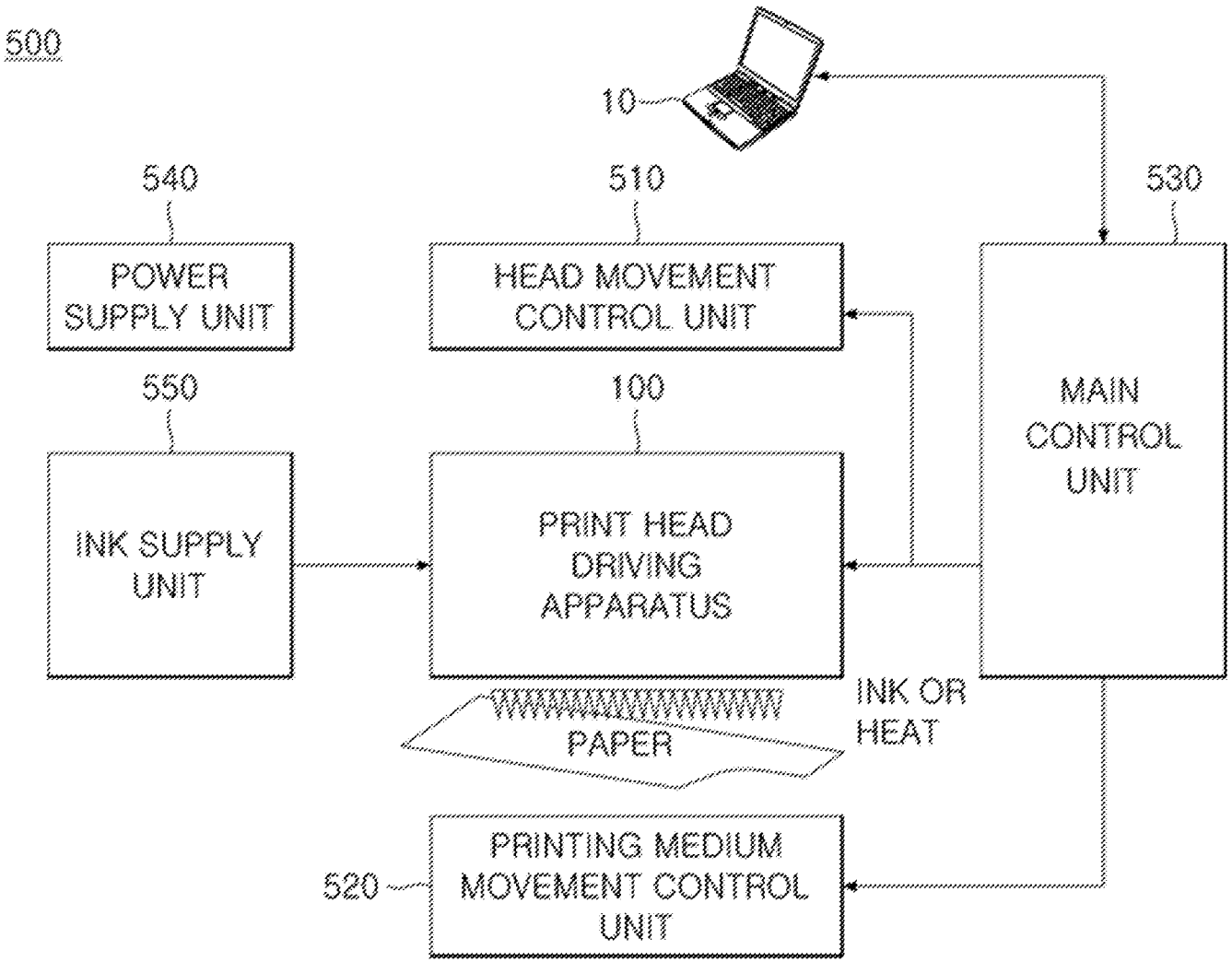
FIG. 9 is a block diagram illustrating a printing apparatus according to an exemplary embodiment of the present invention.

FIG. 9 is a block diagram illustrating a printing apparatus according to an exemplary embodiment of the present invention.

Referring to FIG. 9, a printing apparatus 500 according to the exemplary embodiment of the present invention may include a print head driving apparatus 100, a head movement control unit 510, a printing medium movement control unit 520, a main control unit 530 and a power supply unit 540. In the case of an inkjet printer, an ink supply unit 550 may be further included.

Hereafter, referring to FIG. 9, the printing apparatus according to the exemplary embodiment of the present invention will be described.

The print head driving apparatus 100 may include a plurality of heater resistors, and generate signals for driving the heater resistors. In some exemplary embodiments, the print head module driving apparatus 200 or the printed head block driving apparatus 300 may be provided instead of the print head driving apparatus 100. Since the print head driving apparatus 100, the print head module driving apparatus 200 and the print head block driving apparatus 300 have been described above, the detailed descriptions thereof will be omitted herein.

The head movement control unit 510 may control the movement of the head, and the printing medium movement control unit 520 may control the movement of a printing medium such as a paper.

The main control unit 530 may provide an interface with a device 10 which provides data to print, and typically control overall operations of the printing apparatus by controlling operations of the respective units. The power supply unit 540 may receive external power or internal power, and supply power required for the operations of the respective components. In the case of the inkjet printer, the ink supply unit 550 may supply ink to the print head.

What is claimed is:

1. A print head driving apparatus comprising:

a print head unit having a plurality of heater resistors arranged therein, the plurality of heater resistors being divided into sub groups;

a counter configured to sequentially generate code signals corresponding to the sub groups, using a driving clock signal;

a driving signal generation unit configured to generate a driving signal for the heater resistors included in each of the sub groups, using the code signal; and a head control unit configured to extract heater resistors to which the driving signal is inputted, among heater resistors corresponding to input image data, and drive the extracted heater resistors, wherein the code signals comprise a plurality of bits and correspond to unique numbers of said sub groups respectively.

2. The print head driving apparatus of claim 1, wherein the head control unit performs an AND operation on the driving signal and the image data, extracts heater resistors corresponding to the AND operation result of 1, and drives the extracted heater resistors.

3. The print head driving apparatus of claim 1, wherein the head control unit drives the heater resistors during a pulse retention time of the driving signal.

4. The print head driving apparatus of claim 1, wherein the counter changes the code signal in each cycle of the driving clock signal, and inputs the code signal to the driving signal generation unit while retaining the code signal within the same cycle.

5. The print head driving apparatus of claim 4, wherein when a fire signal is inputted while the code signal is retained, the driving signal generation unit transfers the driving signal to the head control unit in response to the fire signal.

6. The print head driving apparatus of claim 5, wherein the driving signal generation unit sets the transfer timing and the pulse retention time of the driving signal, using the fire signal.

7. The print head driving apparatus of claim 1, further comprising:

a shift register configured to shift image data inputted from an input terminal, and input the shifted image data to a latch unit; and the latch unit configured to store the image data inputted from the shift register according to a latch signal, and input the image data to the head control unit.

8. The print head driving apparatus of claim 7, wherein the counter uses the latch signal as a reset signal.

9. The print head driving apparatus of claim 1, wherein the driving signal generation unit generates the driving signal to turn on a power-driving switching element for driving the heater resistors in a logic high-level period of the driving clock signal.

10. The printing apparatus comprising the print head driving apparatus of any one of claims 1 to 9.

* * * * *